United States Patent [19]

Kitagawa et al.

[11] Patent Number: 4,699,874

[45] Date of Patent: Oct. 13, 1987

[54] PHOTOGRAPHIC POLYETHYLENE COATED PAPER SUPPORT

[75] Inventors: Keishi Kitagawa; Hisamasa Abe, both of Fujinomiya, Japan

[73] Assignee: Fuji Photo Film Co., Ltd., Kanagawa, Japan

[21] Appl. No.: 4,747

[22] Filed: Jan. 7, 1987

Related U.S. Application Data

[63] Continuation of Ser. No. 686,199, Dec. 26, 1984, abandoned, which is a continuation of Ser. No. 445,722, Nov. 30, 1982, abandoned.

[30] Foreign Application Priority Data

Dec. 3, 1981 [JP] Japan ..... 56-193665

[51] Int. Cl.[4] ..... G03C 1/86

[52] U.S. Cl. ..... 430/538; 430/532; 430/536

[58] Field of Search ..... 430/532, 536, 538

[56] References Cited

U.S. PATENT DOCUMENTS

| | | | |
|---|---|---|---|
| 3,247,290 | 4/1966 | Werkman et al. | 156/244.11 |
| 3,411,908 | 11/1968 | Crawford et al. | 430/538 |
| 4,331,508 | 5/1982 | Miyama et al. | 430/538 |

*Primary Examiner*—Jack P. Brammer

*Attorney, Agent, or Firm*—Jules E. Goldberg

[57] ABSTRACT

A photographic support comprising a paper sheet coated with a polyolefin resin on both surfaces thereof, in which at least one of the polyolefin resin layer comprises:

40–75 parts by weight of a high density polyethylene having a melt index of 15–40 g./10 min. and a density of not less than 0.945 g./cm$^3$, and 60–25 parts by weight of a low density polyethylene having a melt index of 1–40 g./10 min. and a density of not higher than 0.930 g./cm$^3$.

5 Claims, No Drawings

PHOTOGRAPHIC POLYETHYLENE COATED PAPER SUPPORT

This is a continuation of application Ser. No. 686,199, filed Dec. 26, 1985, now abandoned which, in turn, is a continuation of application Ser. No. 445,722, filed Nov. 30, 1982, now abandoned.

This invention relates to a photographic support. More particularly, this invention relates to an improvement of a photographic support comprising a paper sheet coated with a polyolefin resin on both surfaces thereof.

A photographic support is required to be superior in dimensional stability, resistance to humidity, hiding power and so on, and not to give an unfavorable influence to a photographic emulsion layer to be placed thereon. Further, superiority in cutting property by a cutter (knife-cutting property) is also required.

A photographic support is generally provided with a transparent polyolefin resin coating layer on one surface thereof and an opaque polyolefin resin coating layer containing a pigment such as titanium dioxide on the other surface. A photographic emulsion layer is placed on the latter opaque polyolefin resin coating layer so as to prepare a photographic paper (photographic material).

The photographic paper is exposed through a negative and the paper is then developed so as to produce a positive image. Subsequently, the photographic paper is cut into a predetermined size by a cutter such as a guillotine cutter. In the cutting procedure, the photographic paper comprising the polyolefin resin-coated paper sheet support receives shearing force between the upper and lower edges of a cutter. Under the shearing force, the polyolefin resin layer is cut not to give a neat section face, but to give a tailing edge. The photographic paper showing such a tailing edge is poor in appearance, resulting in deterioration of commercial value thereof. This phenomenon that the edge becomes irregular comes out more conspicuous on the polyolefin resin layer of the reverse side which is not coated with the photographic emulsion.

As a result of the earnest study in order to overcome the above-mentioned defect of the conventional arts, the present inventors have discovered that a photographic support producing a neatly cut edge face can be given by using a specific polyethylene composition as the polyolefin resin for coating a paper sheet. The present invention has been completed on the above-mentioned discovery.

Accordingly, the object of this invention is to provide a photographic support improved in the above-mentioned problem of the conventional arts.

This invention resides in a photographic support comprising a paper sheet coated with a polyolefin resin on both surfaces thereof, in which at least one of the polyolefin resin layer comprises:

- 40–75 parts by weight of a high density polyethylene having a melt index of 15–40 g./10 min. and a density of not less than 0.945 g./cm$^3$, and
- 60–25 parts by weight of a low density polyethylene having a melt index of 1–40 g./10 min. and a density of not higher than 0.930 g./cm$^3$.

A photographic paper produced by the use of the support according to the invention shows a favorable cut edge face, and this means increase of the value as a photographic paper.

The present invention will be described more in detail in the following.

The photographic support of this invention has a basic structure comprising a paper sheet and polyolefin resin layers coated on the both surfaces of the paper sheet.

The paper sheet is made from materials chosen from those generally used for the preparation of a photographic paper. Examples of these materials include natural pulp paper, synthetic pulp paper, paper made of a mixture of natural pulp and synthetic pulp, and various composite papers. The paper sheet generally has the thickness of 30–500 μm.

In the invention, a polyolefin resin forming at least one of the polyolefin resin coating layers comprises a high density polyethylene and a low density polyethylene, each having the specific properties respectively.

The thickness of the polyolefin resin layer is not limited and can be determined in accordance with the thickness of a resin layer of a polyolefin resin-coated paper used as a conventional photographic support. The thickness of the resin layer is usually chosen from the range of 10–100 μm. and particularly from the range of 15–50 μm.

The high density polyethylene employed in the invention has a melt index of 15–40 g./10 min. (preferably 20–40 g./10 min.) and a density of not less than 0.945 g./cm$^3$ (preferably 0.950–0.970 g./cm$^3$). The low density polyethylene employed in the invention has a melt index of 1–40 g./10 min. (preferably 1–15 g./10 min., more preferably 1–10 g./10 min.) and a density of not higher than 0.930 g./cm$^3$ (preferably 0.915–0.930 g./cm$^3$).

In the invention, the high density polyethylene and low density polyethylene are used at a ratio by weight of 40–75:60–25 (preferably 70–50:30–50, former:latter). A photographic paper prepared from a support coated with the polyethylene composition resin layer consisting of the high density polyethylene more than 75 parts by weight and the low density polyethylene less than 25 parts by weight is not favorable, because it shows unsatisfactory cut edge face at the cutting process, which is poor in appearance.

On the other hand, a photographic paper prepared from a support coated with a polyethylene composition resin layer consisting of less than 40 parts by weight of the high density polyethylene and more than 60 parts by weight of the low density polyethylene possibly shows satisfactory cut edge face at a cutting process. However, a photographic paper comprising a polyethylene composition resin layer of such a composition ratio is not desirable because it shows undesirable in-curling tendency. It is naturally possible to be made free from such an undesirable in-curling property by employing the resin of a higher density or a thicker coating layer. However, these countermeasures are disadvantageous from the economical and working viewpoints.

In the preparation of the photographic support of the invention, both polyolefin resin layers coated on the surfaces of the paper sheet can be made of the aforementioned specific polyethylene composition. However, it is practically advantageous to coat only the reverse surface with said specific polyethylene composition. The reverse surface means a surface on which a photographic emulsion layer is not placed. The other surface can be coated with other polyolefins such as polyolefins employed or proposed for the use in the preparation of polyolefin resin-coated papers.

In case that only the reverse surface receiving no photographic emulsion layer is coated with the polyethylene composition as described above, said polyethylene layer is preferably produced by the use of the polyethylene composition in which the high density polyethylene has a melt index of 20–40 g./10 min. and the low density polyethylene has a melt index of 1–15 g./10 min.

Examples of polyolefin resins which have been used or proposed to use for conventional polyolefin resin-coated papers include homopolymers of α-olefins such as polyethylene and polypropylene, copolymers, of the α-olefins, and mixtures of various kind of these polymers. The molecular weight of the polyolefin resin is not particularly limited as far as it can be processed through extrusion coating, but a polyolefin resin having a molecular weight of 20,000–200,000 is generally employed.

It has been already known that various kinds of additives such as white pigment, color pigment, optical whitening agent and antioxidant can be incorporated into a polyolefin resin used for producing the resin layer of a photographic polyolefin resin-coated paper. One or several of these various additives can be incorporated into the polyolefin resin and/or the aforementioned polyethylene composition, and the incorporation of the additives can be even desirable depending on purposes. As for the additives, U.S. Pat. Nos. 3,833,380, 4,169,188, 3,501,298, 3,449,257 and 3,499,762 disclose in detail, kinds, amount and method of addition of these various kinds of additives. Further, as described in U.S. Pat. No. 3,884,692, these additives can be coated on a resin layer after the layer is placed. Furthermore, as described in U.S. Pat. Nos. 2,715,075, 2,846,727, 3,549,406 and 3,590,107, a surface activation processing can be carried out on the resin coating layer, if needed.

There is no limitation on the method for blending the high density polyethylene and the low density polyethylene to prepare the polyethylene composition used in the invention, and an optional method can be employed. For example, a method in which a desired amount of the high density polyethylene, that of the low density polyethylene and various kinds of additives, if necessary, are kneaded by means of a kneading extruder, a heat kneading roller, a Banbury mixer or a kneader, and the so prepared mixture is then pulverized or made into pellets can be employed. Alternatively, a method in which a simple mixture of the high density polyethylene, the low density polyethylene and various kinds of additives, if necessary, are charged into an extruder, and coated through extrusion can be employed.

In order to prepare a photographic paper by coating a photographic emulsion on the photographic support of the invention, conventional methods employable in the preparation of photographic papers can be also employed. Further, treatments such as development and fixing of the so prepared photographic papers can be carried out by means of conventional processes. These conventional processes are described in detail in texts such as "PHOTOGRAPHIC CHEMISTRY" written by Shin-ichi Kikuchi (Kyoritsu Shuppan: 1973) and "THE THEORY OF THE PHOTOGRAPHIC PROCESS" 3rd. ed., written by C. E. K. Mees.

Examples and Comparison examples of the invention will be given hereinbelow. In these examples, the evaluation on cut edge face of a photographic paper and support thereof was carried out as follows.

"Tailing edge (extended edge portion)" of a polyethylene resin layer of a photographic paper produced by means of a cutter (guillotine cutter) was observed and evaluated according to four ranks of A, B, C and D. A means that the cut edge face of a resin layer is satisfactorily neat without tailing; B means that the cut edge of a resin layer in part shows a little tailing; C means that substantially all over the cut edge of a resin layer shows tailing; and D means that all over the cut edge of a resin layer shows extensive tailing. Practically satisfactory are those given the rank A or B according to this evaluation.

EXAMPLES 1–3 AND COMPARISON EXAMPLES 1–3

On one surface of a fine quality paper weighing 150 g./m$^2$, a polyethylene composition consisting of a high density polyethylene having a melt index of 35 g./10 min. and a density of 0.960 g./cm$^3$ and a low density polyethylene having a melt index of 2 g./10, min. and a density of 0.925 g./cm$^3$ was coated through extrusion at 310° C. so as to produce a coating layer of 0.040 mm thick. On the other surface, a low density polyethylene having a melt index of 20 g./10 min. and a density of 0.923 g./cm$^3$ and containing 10% by weight of titanium dioxide was coated through extrusion so as to produce a coating layer of 0.035 mm thick. Subsequently, a photographic color emulsion layer of 0.012 mm thick was placed on the latter coating layer to prepare a photographic paper.

The photographic paper was dried after development and subjected to the cutting test using a guillotine cutter (the evaluation was made on the polyethylene composition layer on which the photographic emulsion layer was not placed). The ratio by weight of the high density polyethylene and the low density polyethylene in the polyethylene compositions used in the examples and the results of evaluations on the cut edge face and curling tendency are set forth in Table 1, in which "good" means out-curling tendency and "bad" means in-curling tendency.

TABLE 1

| | Polyethylene ratio (high density/ low density) | Cut edge face | Curling tendency |
|---|---|---|---|
| Example | | | |
| 1 | 75/25 | B | good |
| 2 | 60/40 | A | good |
| 3 | 40/60 | A | nearly good |
| Comparison example | | | |
| 1 | 100/0 | D | good |
| 2 | 80/20 | C | good |
| 3 | 30/70 | C | bad |

EXAMPLE 4 AND COMPARISON EXAMPLES 4–6

A photographic paper was prepared in the same manner as in Example 1 except for using a polyethylene composition consisting of a high density polyethylene having a melt index of 20 g./10 min. and a density of 0.950 g./cm$^3$ and a low density polyethylene having a melt index of 3 g./10 min. and a density of 0.920 g./cm$^3$. The same cutting test was then carried out on the so prepared photographic paper.

The ratio by weight of the high density polyethylene and the low density polyethylene in the polyethylene compositions used in the examples and the results of the evaluations on the cut edge face and curling tendency are set forth in Table 2.

TABLE 2

| | Polyethylene ratio (high density/ low density) | Cut edge face | Curling tendency |
|---|---|---|---|
| Example | | | |
| 4 | 60/40 | A | good |
| Comparison example | | | |
| 4 | 100/0 | D | good |
| 5 | 80/20 | C | good |
| 6 | 35/65 | A | bad |

EXAMPLE 5 AND COMPARISON EXAMPLES 7 AND 8

A photographic paper was prepared in the same manner as in Example 1 except for using a polyethylene composition consisting of a high density polyethylene having a melt index of 18 g./10 min. and a density of 0.963 g./cm$^3$ and a low density polyethylene having a melt index of 20 g./10 min. and a density of 0.927 g./cm$^3$. The same cutting test was then carried out on the so prepared photographic paper.

The ratio by weight of the high density polyethylene and the low density polyethylene in the polyethylene compositions used in the examples and the results of evaluations on the cut edge face and curling tendency are set forth in Table 3.

TABLE 3

| | Polyethylene ratio (high density/ low density) | Cut edge face | Curling tendency |
|---|---|---|---|
| Example | | | |
| 5 | 60/40 | A | good |
| Comparison example | | | |
| 7 | 100/0 | D | good |
| 8 | 80/20 | C | good |

EXAMPLE 6 AND COMPARISON EXAMPLES 9 AND 10

A photographic paper was prepared in the same manner as in Example 1 except for using a polyethylene composition consisting of a high density polyethylene having a melt index of 17 g./10 min. and a density of 0.965 g./cm$^3$ and a low density polyethylene having a melt index of 5 g./10 min. and a density of 0.921 g./cm$^3$. The same cutting test was then carried out on the so prepared photographic paper.

The ratio by weight of the high density polyethylene and the low density polyethylene in the polyethylene compositions used in the examples, and the results of the evaluations on the cut edge face and curling tendency are set forth in Table 4.

TABLE 4

| | Polyethylene ratio (high density/ low density) | Cut edge face | Curling tendency |
|---|---|---|---|
| Example | | | |
| 6 | 60/40 | B | good |
| Comparison example | | | |
| 9 | 100/0 | D | good |
| 10 | 80/20 | C | good |

EXAMPLE 7 AND COMPARISON EXAMPLE 11

On one surface of a fine quality paper weighing 100 g./m$^2$, a mixture in the form of pellets obtained by simply blending pellets of a high density polyethylene having a melt index of 40 g./10 min. and a density of 0.970 g./cm$^3$ and pellets of a low density polyethylene having a melt index of 1 g./10 min. and a density of 0.919 g./cm$^3$ was coated through extrusion at 300° C. so as to produce a coating layer of 0.020 mm thick. On the other surface, a low density polyethylene having a melt index of 5 g./10 min. and a density of 0.920 g./cm$^3$ and containing 7% by weight of titanium dioxide was coated through extrusion to produce a coating layer of 0.020 mm thick. Subsequently, a photographic black-and-white emulsion layer of 0.005 mm thick was placed on the resin coating layer to prepare a photographic paper.

The photographic paper was dried after development and subjected to the cutting test by means of a photographic cutter (the evaluation was made on the polyethylene composition layer on which the photographic emulsion layer was not placed). The ratio by weight of the high density polyethylene and the low density polyethylene in the polyethylene compositions used in the examples, and the results of the evaluations on the cut edge face and curling tendency are set forth in Table 5.

TABLE 5

| | Polyethylene ratio (high density/ low density) | Cut edge face | Curling tendency |
|---|---|---|---|
| Example | | | |
| 7 | 75/25 | A | good |
| Comparison example | | | |
| 11 | 100/0 | C | good |

EXAMPLE 8 AND COMPARISON EXAMPLE 12 AND 13

A photographic paper was prepared in the same manner as in Example 7 except for using a polyethylene composition consisting of a high density polyethylene having a melt index of 22 g./10 min. and a density of 0.950 g./cm$^3$ and a low density polyethylene having a melt index of 7 g./10 min. and a density of 0.917 g./cm$^3$. The same cutting test was then carried out on the so prepared photographic paper.

The ratio by weight of the high density polyethylene and the low density polyethylene in the polyethylene compositions used in the examples and the results of evaluations on the cut edge face and curling tendency are set forth in Table 6.

TABLE 6

| | Polyethylene ratio (high density/ low density) | Cut edge face | Curling tendency |
|---|---|---|---|
| Example | | | |
| 8 | 70/30 | A | good |
| Comparison examples | | | |
| 12 | 100/0 | D | good |
| 13 | 80/20 | C | good |

EXAMPLES 9 AND 10 AND COMPARISON EXAMPLES 14–16

A photographic paper was prepared in the same manner as in Example 7 except for using a polyethylene composition consisting of a high density polyethylene having a melt index of 15 g./10 min. and a density of 0.955 g./cm$^3$ and a low density polyethylene having a melt index of 20 g./10 min. and a density of 0.924 g./cm$^3$. The same cutting test was then carried out on the so prepared photographic paper.

The ratio by weight of the high density polyethylene and the low density polyethylene in the polyethylene compositions used in the examples and the results of evaluations on the cut edge face and curling tendency are set forth in Table 7.

TABLE 7

| | Polyethylene ratio (high density/ low density) | Cut edge face | Curling tendency |
|---|---|---|---|
| Example | | | |
| 9 | 60/40 | B | good |
| 10 | 40/60 | A | nearly good |
| Comparison example | | | |
| 14 | 100/0 | D | good |
| 15 | 80/20 | C | good |
| 16 | 30/70 | B | bad |

We claim:

1. In a method for producing a photographic support paper wherein a paper sheet is coated with a transparent polyolefin resin layer on one surface and an opaque polyolefin layer on the opposite surface, the improvement which comprises said opaque polyolefin resin layer comprising a polyethylene resin and said transparent resin layer being from about 15 to 50 micrometers thick and said transparent resin comprising 40–75 parts be weight of a high density polyethylene having a melt index of 20–40 g/10 min. and a density of 0.950–0.970 g/cm$^3$ and 60–25 parts by weight of a low density polyethylene having a melt index of 1–15 g/10 min. and a density of 0.915–0.930 g/cm$^3$, whereby the curling tendency and edge tailing are reduced.

2. The method of claim 1 wherein the ratio of the high density polyethylene to the low density polyethylene is 70–50 to 30–50, by weight.

3. The method of claim 1 wherein the melt index of the low density polyethylene is in the range of 1–10 g/10 min.

4. The method of claim 1 wherein the polyethylene resin of the opaque polyolefin resin layer comprises a low density polyethylene.

5. The method of claim 1 wherein the opaque polyolefin resin layer consists essentially of a low density polyethylene and a pigment.

* * * * *